US010538919B2

(12) United States Patent
Lowe et al.

(10) Patent No.: US 10,538,919 B2
(45) Date of Patent: Jan. 21, 2020

(54) SPACED VENT FOR METAL ROOFS

(71) Applicants: Cor-A-Vent, Inc., Mishawaka, IN (US); Carl Zimmerman, Shiloh, OH (US)

(72) Inventors: Steven E. Lowe, South Bend, IN (US); Carl Zimmerman, Shiloh, OH (US)

(73) Assignee: Cor-A-Vent, Inc., Mishawaka, IN (US)

( * ) Notice: Subject to any disclaimer, the term of this patent is extended or adjusted under 35 U.S.C. 154(b) by 0 days.

(21) Appl. No.: 16/010,575

(22) Filed: Jun. 18, 2018

(65) Prior Publication Data

US 2018/0291630 A1 Oct. 11, 2018

Related U.S. Application Data

(63) Continuation of application No. 15/170,478, filed on Jun. 1, 2016, now Pat. No. 10,000,930.

(51) Int. Cl.

| | |
|---|---|
| ***E04D 1/30*** | (2006.01) |
| ***F24F 7/02*** | (2006.01) |
| ***F24F 13/08*** | (2006.01) |
| ***E04D 13/17*** | (2006.01) |

(52) U.S. Cl.

CPC ..... *E04D 1/30* (2013.01); *E04D 13/174* (2013.01); *F24F 7/02* (2013.01); *E04D 2001/305* (2013.01); *E04D 2001/309* (2013.01)

(58) Field of Classification Search

CPC ..... E04D 1/30; E04D 2001/305; E04D 2001/309; E04D 13/36; E04D 13/174; E04D 13/176; E04D 13/402; F24F 7/02; F24F 13/08

USPC ..... 55/385.1, 524, 529; 52/198, 199, 309.5, 52/518; 454/364–367

See application file for complete search history.

(56) References Cited

U.S. PATENT DOCUMENTS

| | | | | |
|---|---|---|---|---|
| 3,777,649 | A | 12/1973 | Luckey | |
| 3,828,494 | A | 8/1974 | Uhrhane et al. | |
| 5,288,269 | A | 2/1994 | Hansen | |
| 5,352,154 | A | 10/1994 | Rotter et al. | |
| 6,105,314 | A | 8/2000 | Stocksieker | |
| 6,491,581 | B1 | 12/2002 | Mankowski | |
| 6,537,147 | B2 * | 3/2003 | Smith | E04D 1/3402 454/365 |
| 6,599,184 | B2 | 7/2003 | Morris | |
| 6,773,342 | B2 | 8/2004 | Rotter | |
| 6,997,800 | B1 | 2/2006 | Kohler | |
| 7,788,857 | B2 | 9/2010 | Spengler et al. | |
| 9,151,059 | B2 | 10/2015 | Pavlansky et al. | |
| 10,000,930 | B2 * | 6/2018 | Lowe | E04D 1/30 |
| 2001/0052207 | A1 | 12/2001 | Davis | |
| 2006/0280911 | A1 | 12/2006 | Verkamp | |
| 2008/0034685 | A1 | 2/2008 | Ogletree | |

(Continued)

*Primary Examiner* — Minh Chau T Pham

(57) ABSTRACT

A roof ventilation system is provided that is configured to be mounted on a profiled paneled roof for venting air from a vent opening in the roof. The roof ventilation system can include a vent part having a plurality of vent passages, a plurality of plies configured to be mounted substantially horizontal to the profiled roof panels and a plurality of cross members extending between each ply, wherein the plies and cross members define the vent passages; and a filter member attached to outer surfaces of the vent part. The filter member can be made from a resilient material, and the filter member may include extensions extending beyond a length of the vent part.

29 Claims, 7 Drawing Sheets

(56) References Cited

U.S. PATENT DOCUMENTS

| | | | | |
|---|---|---|---|---|
| 2008/0236076 | A1* | 10/2008 | Hofmann | E04D 1/36 52/309.5 |
| 2012/0047828 | A1 | 3/2012 | Bahn | |
| 2012/0096782 | A1 | 4/2012 | Railkar | |
| 2015/0159378 | A1* | 6/2015 | Manasterski | E04D 13/174 52/302.1 |
| 2017/0037634 | A1* | 2/2017 | Glick, Jr. | E04D 13/174 |
| 2018/0156480 | A1* | 6/2018 | Bourque | F24F 5/0035 |

* cited by examiner

SPACED VENT FOR METAL ROOFS

CROSS-REFERENCE TO RELATED APPLICATION

The present application claims priority to U.S. patent application Ser. No. 15/170,478, filed Jun. 1, 2016, the complete disclosure of which is expressly incorporated herein by reference.

BACKGROUND OF THE INVENTION

This invention relates to spaced vent parts for placement between upstanding seam joints/stiffening profiles of a roofing system in the ridge area of a roof, and in particular, the invention relates to vent parts including a plurality of vent openings extending parallel to the joints/stiffening profiles and furthering including a filter member that seals around the vent parts.

In one well-known type of roof for use of the subject invention, metal roofs are widely used and as with most sloped roofs require venting through an opening in the ridge of a roof. Additionally, metal roofs are known to expand and this type of expansion can cause uneven movement, noise, and wear of high wind dome caps and associated venting closures. An additional problem is that of environmental forces such as wind, ice or snow compressing high wind dome caps to a point where water does not run off. Additionally, the expansion of the metal roof may vary from panel to panel and from side to side along the roof thereby causing additional problems with prior art top cap ventilation systems.

One prior art patent disclosing a metal roof ventilation system is U.S. Pat. No. 5,352,154 to Rotter et al. The system in Rotter et al includes segments of air-permeable venting sections located between standing seams or ridges in the metal roof. Clips are provided that include a groove for receiving air permeable venting sections, and fasteners may be used to secure a roof cap to the clips. The preferred venting material is a non-woven synthetic fiber matting.

Another venting system for metal roofs is disclosed in U.S. Pat. No. 9,151,059 B2 to Pavlansky et al. Pavlansky et al. does not have individual sections between ridges/seams of the metal roof, but rather has strips having an air impermeable backing. The backing members include contours to fit over stiffening ridges on the metal roof. Between the contours, open cell foam members are adhered to the backing member to provide venting to the roof.

U.S. Pat. No. 7,788,856 B2 to Spengler et al. disclosures a closure rail for roofing. The closure rail may be secured along a ridge, hip, or eave of a roof to receive and secure panels in a roofing system.

U.S. Patent Application Publication No. 2008/0034685 A1 to Ogletree discloses a roof ventilation device. The system may include a core, a filter and a spanner. The core can be configured to conform to a roof surface irregularity. The filters are configured to hinder rain and debris from entering into the vent opening, and the spanner is configured to allow the roof ventilation system to be adjustable for roof slopes.

U.S. Patent Application Publication No. 2006/0280911 A1 to Verkamp discloses a universal roof enclosure, including a strip of visco-elastic foam, on top of which is affixed a strip of closed cell foam. When the closure is positioned between a corrugated roofing panel having a valley or trough, strips of the visco-elastic foam expand to fill adjacent voids to prevent the passage wind, rain, noise and animals. The visco-elastic foam is designed to confirm to ridges on the roof. A ventilation member is provided that consists of strips of corrugated plastic having a multiplicity of open channels that may be attached atop the closed cell foam strip.

U.S. Pat. No. 6,599,184 B2 to Morris discloses a ridge capped vent including strips of corrugated material placed over foam rubber strips, which are designed to accommodate the non-even contours presented by ribs and lips on steel sheet roof panels.

U.S. Patent Application Publication No. 2001/0052207 A1 to Davis discloses a roofing ventilation system including vent panels extending across and perpendicular to ridges on a roof. The vent panel includes vent openings there through. The vent panels are attached to rain closures which comprise a face and upper and lower flanges extending from opposite ends of the face. The rain closures may be formed from single pieces of metal and are located between the ridges on a roof. Only the rain closures which do not accommodate venting are sectioned between the ridges, whereas the vent panel extends across the length of the roof.

U.S. Pat. No. 6,105,314 to Stocksieker discloses a panel system for use on walls and roofs. The system includes upper panels mounted on a filler board with a notch formed at the base of the filler board on both vertical edges and a lower panel locked into the notch. Vertical edges of the upper panels are folded over edges of the lower panels to form a sealed joint and retain both panels in place.

U.S. Pat. No. 3,828,494 to Uhrhane et al. discloses a roof jack. The jack has a channel which receives water flowing down a roof and diverts the same around stacks or vents so that the water continually flows and no puddles are formed.

SUMMARY OF THE INVENTION

In one embodiment of the invention, a roof ventilation system is provided that is configured to be mounted on a profiled paneled roof for venting air from a vent opening in the roof. The roof ventilation system can include a vent part having a plurality of vent passages, a plurality of plies configured to be mounted substantially horizontal to the profiled roof panels and a plurality of cross members extending between each ply, wherein the plies and cross members define the vent passages; and a filter member attached to outer surfaces of the vent part. The filter member can be made from a resilient material, and the filter member may include extensions extending beyond a length of the vent part.

The vent part can be configured to be mounted between adjacent upstanding projections on the profiled paneled roof, and the vent passages may run substantially parallel to the projections. The extensions can be located between the vent parts and respective projections.

The filter member may be provided in a sheet form and be in contact with outer surfaces of lower and upper plies of the vent part. In one embodiment, the filter member covers outer openings of the vent passages, and before installation, and the extensions have a generally U-shaped configuration. The extensions are folded about outer ends of the vent parts, and the resilient material of the filter members expands to fill any gaps between the outer ends of the vent parts and the projections.

The roof ventilation system may also include adhesive pads attached to an outer surface of the plies for temporarily attaching said vent part to the profiled paneled roof.

The roof ventilation system may further include at least one additional layer of material attached to an outer ply of the vent part. The additional layer of material includes a plurality of plies, cross members extending between each ply, and through passages defined by the plies and cross members of the additional layer. The through passages extend substantially perpendicular to the vent passages.

In another embodiment of the invention, a method for venting a roof covered with profiled panels is provided that includes the steps of providing a vent opening in a roof covered with a plurality of profiled panels; providing a vent part having a plurality of vent passages, a plurality of plies, and a plurality of cross members extending between each ply, the plies and cross members defining the vent passages; attaching a filter member to outer surfaces of the vent part, the filter member being made of a resilient material and including extensions extending beyond the length of the vent part; providing a plurality of upstanding projections on the metal panels on the roof, the projections extending substantially perpendicular to the vent opening; folding the extensions about outer ends of the vent part; and mounting the vent part between adjacent projections so that the vent passages run substantially parallel to the projections.

The method for venting a roof covered with profiled panels may also include the step of attaching the filter member to outer surfaces of upper and lower plies of the vent part.

The method for venting a roof covered with profiled panels may further include the steps of providing adhesive pads on the outer surface of the lower ply, wherein the adhesive pad is not covered by the filter member, and temporarily attaching the vent part to one of the metal panels on the roof using the adhesive pads. The extensions may have a substantially U-shaped configuration before being installed on the roof, and when installed on the roof between projections, and the extensions on the filter members expand to fill any gaps therebetween. The filter member may cover outer openings of the vent passages.

The method for venting a roof covered with metal may include the steps of providing a ridge cap, and covering the vent opening and the vent part with the ridge cap.

In one embodiment, the method for venting a roof covered with profiled panels may include the step of providing at least one additional layer on the vent part wherein the additional layer has a configuration different than the vent passages, plies and cross members of the vent part. The method for venting a roof covered with profiled panels may also include the steps of providing a plurality of through passages, plies, and cross members, to define the additional layer, the through passages running substantially transverse to the vent passages.

The method for venting a roof covered with profiled panels may additionally include the step of attaching the additional layer to an outer surface of one of the plies on the vent part.

BRIEF DESCRIPTION OF THE PHOTOS

The above-mentioned and other features and objects of this invention and the manner of obtaining them will become more apparent, and the invention itself will be better understood by reference to the following description of embodiments of the present invention taken in conjunction with the accompanying photo, wherein.

Figure 1:
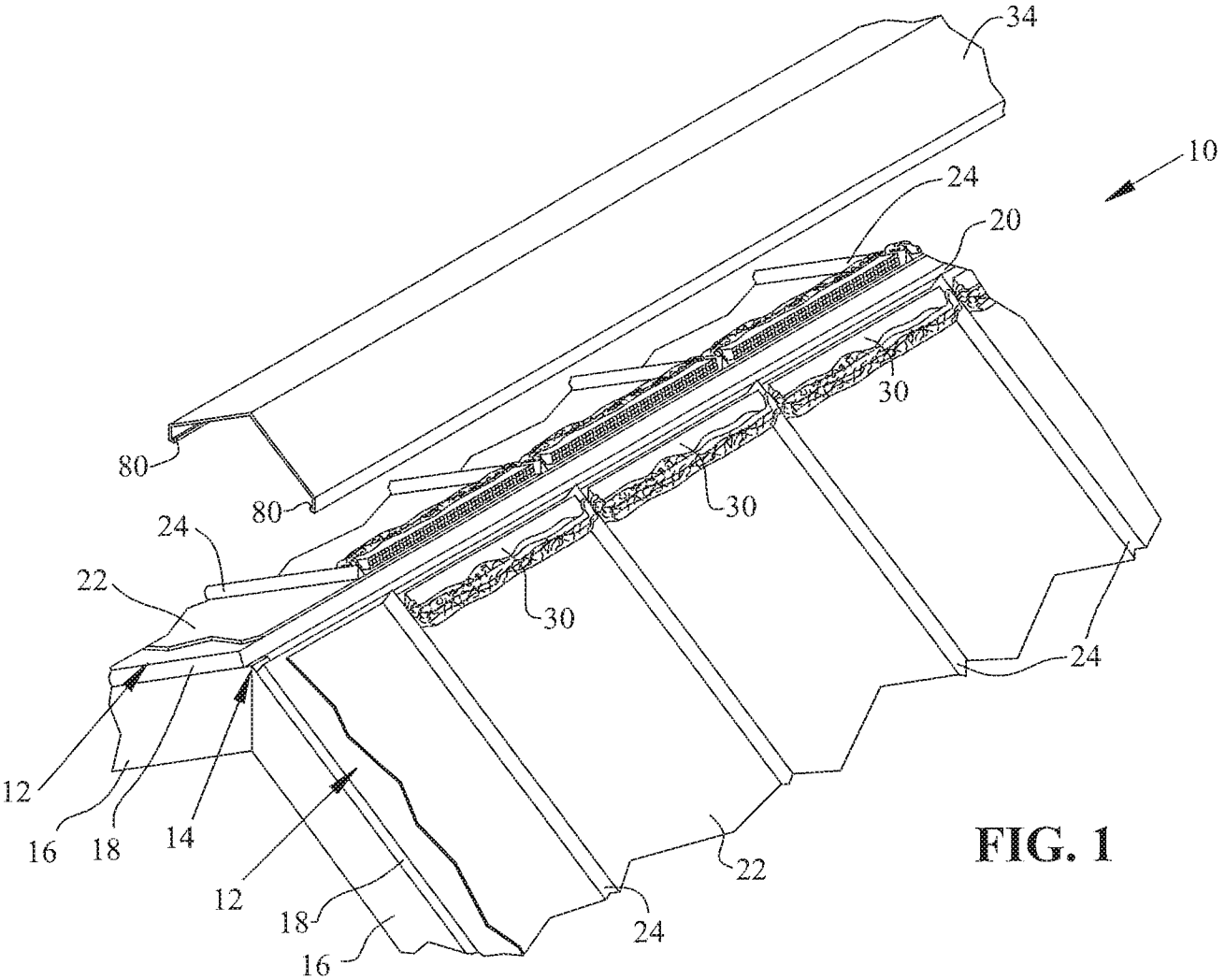
FIG. 1 is a perspective view showing a roof having spaced vent parts and filter members of the subject invention placed between upstanding joints or stiffening profiles on roof panels with a ridge cap in an exploded position for clarity.

Corresponding reference characters indicate corresponding parts throughout the several views. Although the photo represents embodiments of the present invention, the photo is not necessarily to scale and certain features may be exaggerated in order to better illustrate and explain the present invention. The exemplification set out herein illustrates embodiments of the invention, and such exemplifications are not to be construed as limiting the scope of the invention in any manner.

DETAILED DESCRIPTION OF EMBODIMENTS OF THE INVENTION

For the purpose of promoting an understanding of the principles of the invention, reference will now be made to the embodiments illustrated in the photos, which are described below. It will nevertheless be understood that no limitation of the scope of the invention is thereby intended. The invention includes any alterations and further modifications in the illustrated devices and described methods and further applications of the principles of the invention, which would normally occur to one skilled in the art to which the invention relates.

Referring to FIG. 1, a roof ventilation system, generally indicated as 10, is shown for use in venting roofs covered with profiled panels or sheathing. In the embodiment shown, a sloped roof, generally indicated as 12 meets to form a ridge, generally indicated as 14. Roof 12 may also include rafters 16, underlying sheathing 18 and a vent opening 20 running longitudinally along ridge 14. Roof 12 also includes profiled panels or sheathing 22, which cover underlying sheathing 18 and include upstanding joint seams and/or stiffeners 24, which run generally perpendicular to vent opening 20. Profiled panel or sheathing 22 may be a known metal roof as discussed above, which may be steel, galvanized steel, aluminum or stainless steel for example. Alternately, panels 22 may be made from other suitable materials such as fiber glass or plastic. A plastic roof may be extruded, molded, or thermal formed panel that also has upstanding seams and/or projections to provide stiffness and an overlapping moisture resistant seal.

Figure 2:
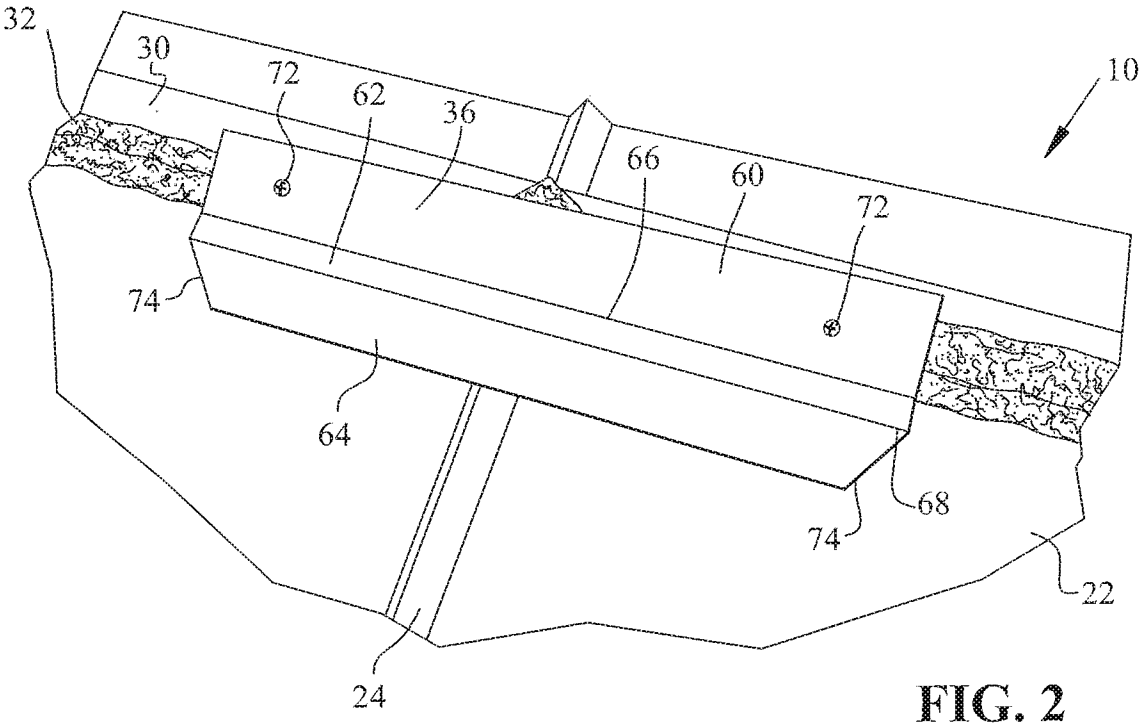
FIG. 2 is a perspective view of an enlarged area of the vent parts including a cleat that facilitates attachment of the vent parts to the roof and which can be used to attach the ridge cap without fasteners.

Roof ventilation system 10 includes a plurality of vent parts 30, filter members 32, and a ridge cap 34. Referring now to FIG. 2, roof ventilation system 10 may also include a clip 36 which can be used to attach ridge cap 34 to the roof without the use of exposed screws or other separate exposed fastening elements as will be discussed in greater detail.

Now referring to FIGS. 3-5 and 7, vent parts 30 and filter members 32 will be discussed in further detail. In the embodiment shown, vent parts 30 are configured to fit in the spacing on metal roof panels 22 between adjacent joints or stiffening projections 24 (see FIG. 3). Vent parts 30 each includes a multiplicity of vent passages 40. In the embodiment shown, vent passages 40 have a generally rectangular configuration with each vent passage 40 is defined by a top and bottom ply of material 42 and cross members 44 extending between each ply. As shown, ply 42 extend across the length of each vent part 30, whereas cross members 44 extend vertically and perpendicular to the plies. It should further be appreciated that vent passages 40 extend completely from the front to the back of each vent part 30 and are open to the air and environment. Vent parts 30 may be made from any suitable material, including but not limited to, a plastic or metal. In one embodiment, vent parts 30 may be manufactured from extruded polypropylene, which may be new, recycled, or partially recycled. Such material lends itself to the extrusion process while being very resistant to environmental degradation and weather factors. It should further be appreciated that although vent passages 40 are shown having a generally rectangular configuration, other shapes of vent passages, plies, and cross members may be utilized such as a corrugated material having undulating plies with ridges and valleys or other cross sectional configurations. In the embodiment shown, vent part 30 has three generally horizontal rows of vent passages 40. It should be appreciated that vent part 30 may include more or less row and/or columns as may be desired for proper stiffness and venting of roof 12.

Figure 9:
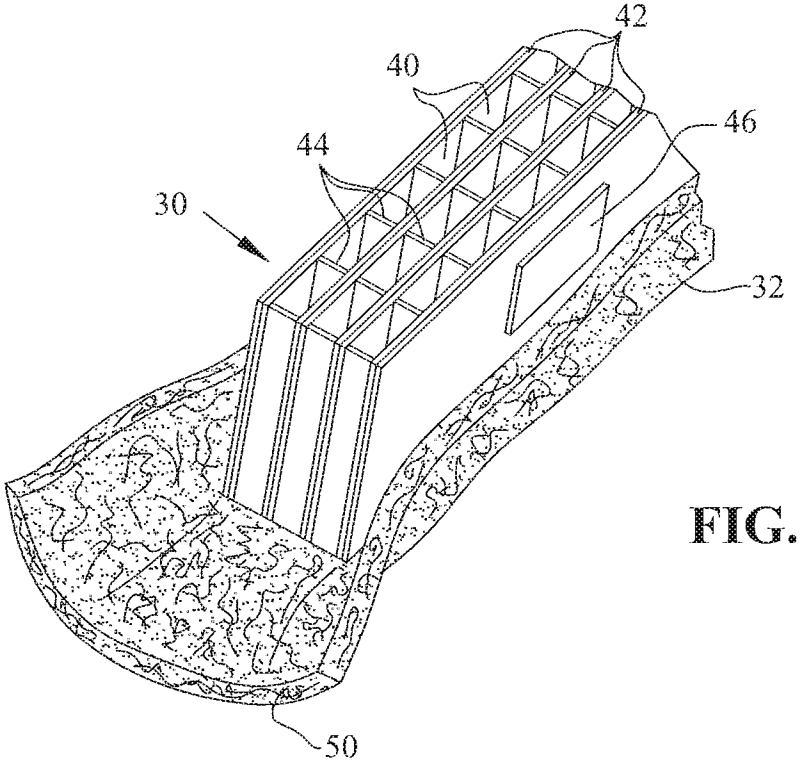
FIG. 9 is a bottom perspective view of the vent part with adhesive pads.

Vent parts 30 may include adhesive strips 46 or other fastening strips such as velcro strips, on the bottom ply (see FIG. 9), to facilitate temporarily adhering the vent parts to metal roof 22 during assembly.

Figure 7:
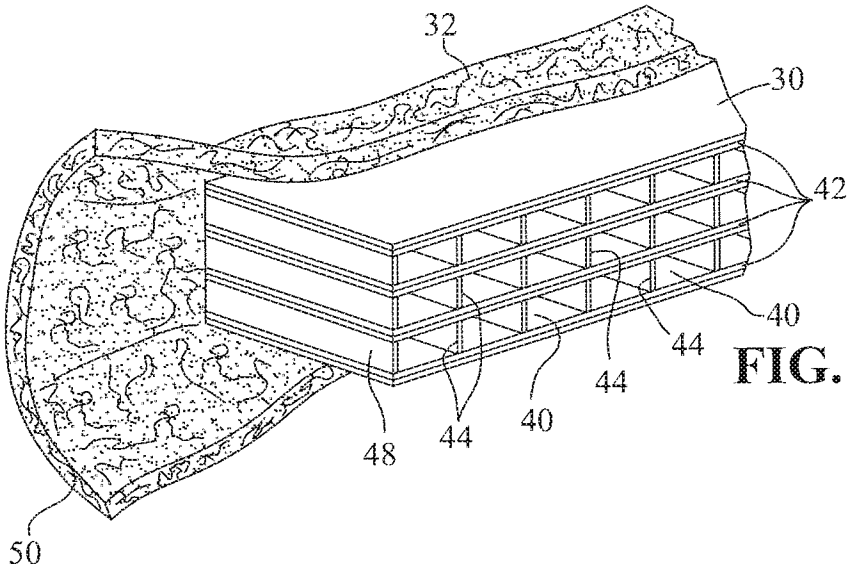
FIG. 7 is an end perspective view of a vent piece and filter member removed from the profiled roof.

Regarding filter member 32, in the embodiment shown, the filter extends along the length of the vent parts and there beyond as discussed below in further detail. Filter members can be provided in a sheet form which may be a non-woven fabric, and in particular, may be in polyester fiber-bonded material having polyvinyl chloride binder. In one embodiment, the filter members include 60% fiber and 40% binder. The filter material is preferably flame retardant but may be heat sealable. In the embodiment shown, the filter members are attached to the top ply 42 of vent parts 30 wrapped over and cover the front or outer openings of vent passages 40 (i.e., the openings of vent passages 40 to be placed closest to the ridge 14 or vent opening 20 in roof 12) and then at least partially overlapping and attached to bottom ply 42 of vent parts 30 which will be in contact with profiled roof panel 22 when assembled. It should be appreciated that filter member 32 may be attached to vent part 30 using an adhesive however other suitable bonding processes may be utilized such as infrared heat or by impulse sealing. It should be further appreciated that filter member may be completely adhered to the vent part 30 or may be only attached along the top and bottom vent plies. If impulse sealing is used, pressure may be applied to the filter member with a flat heated wire strip running the length of the vent. It is further possible that the strip may be only attached to the top and/or bottom ply and not both. For instance, when vent part 30 is mounted in place on sheet panel 22 and screws or other fasteners are used to attach it, such assembly would maintain this filter member in place. It should further be appreciated the filter member may be water repellent and water non-absorbing to help keep snow and rain from entering into vent opening 20, or alternately, the filter member may be water absorbing. A water absorbing material would allow dirt, dust and other debris caught in the filter to be flushed out when hit by precipitation but may still keep out sufficient volume of moisture to prevent it from entering into vent opening 20. As best shown in FIG. 7, filter member 32 includes extensions 50 extending beyond ends 48 of vent part 30.

Figure 6:
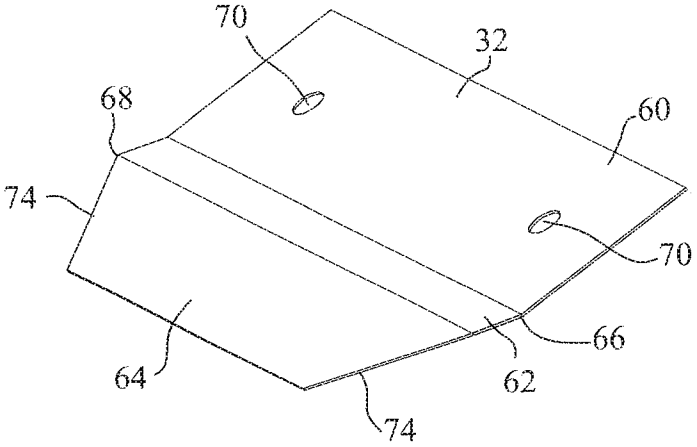
FIG. 6 is a perspective view of a cleat in isolation.

Referring now to FIGS. 2 and 6, in the embodiment shown, cleat 36 is comprised of three planar portions including a base portion 60, a riser or angled portion 62, and a cap engagement portion 64. Cleat 60 may be made from any suitable material, such as a rust resistant metal or plastic. In one embodiment, cleat 36 is manufactured from a piece of aluminum, stainless steel, and/or galvanized steel sheet plate. A metal sheet plate may be bent along one end of base portion 60 to form an angled bend 66, thereby creating riser or angled portion 62, which extends up and away from base portion 60 and vent parts 30 to which it is mounted. Then, along an opposite end of riser portion 62, another bend 68 is formed to create capped engagement portion 64 which lies generally in the same plane as base portion 60. Base portion 60 also includes through holes 70 which can be used to mount cleat 36 to vent parts 30 and roof 12 using screws or other fasteners 72. Cap engagement portion 64 may include angled surfaces 74 along side edges thereof to facilitate receipt of ridge cap 34 as discussed further below.

Figure 3:
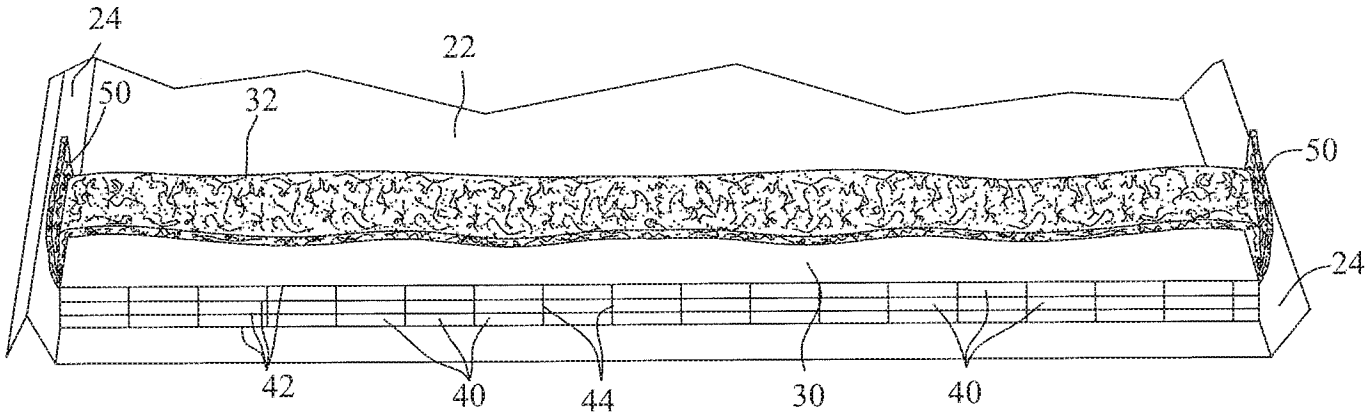
FIG. 3 is a rear perspective view of vent openings on an interior of one vent part.

To use and assemble roof ventilation system 10 on a profiled roof, a plurality of vent parts 30 having fiber members 32 with extensions 50 thereon are provided in a length as will just fit between joint seams or stiffening members 24 of metal roof panels 22. As noted, adhesive or fastening strips 46 may be provided on at least one of the outer planar surfaces of the plies 42 for use in temporarily positioning and holding vent parts 30 in position on profiled roof panels 22 as shown in FIGS. 1 and 3. As is known and appreciated by one skilled in the art, joint seams or stiffening members 24 are typically wider at the base adjacent to the planar portions of profiled roof panels 22 than at the apex thereof. Accordingly, without extensions 50, a gap or space will be created between the ends of vent parts 30 and the respective joint seams or stiffening members 24 between which the vent part is located. In particular, even if this vent part 30 fits tightly between stiffeners 24 at the base, as the stiffeners angle in toward the apex, a gap will be created between the stiffeners and the vent parts toward the upper portions thereof. Proper use of extensions 50 can be used to remedy this situation so that no excessive gaps for ingress of moisture, dirt, insects or other debris is created.

Figure 4:
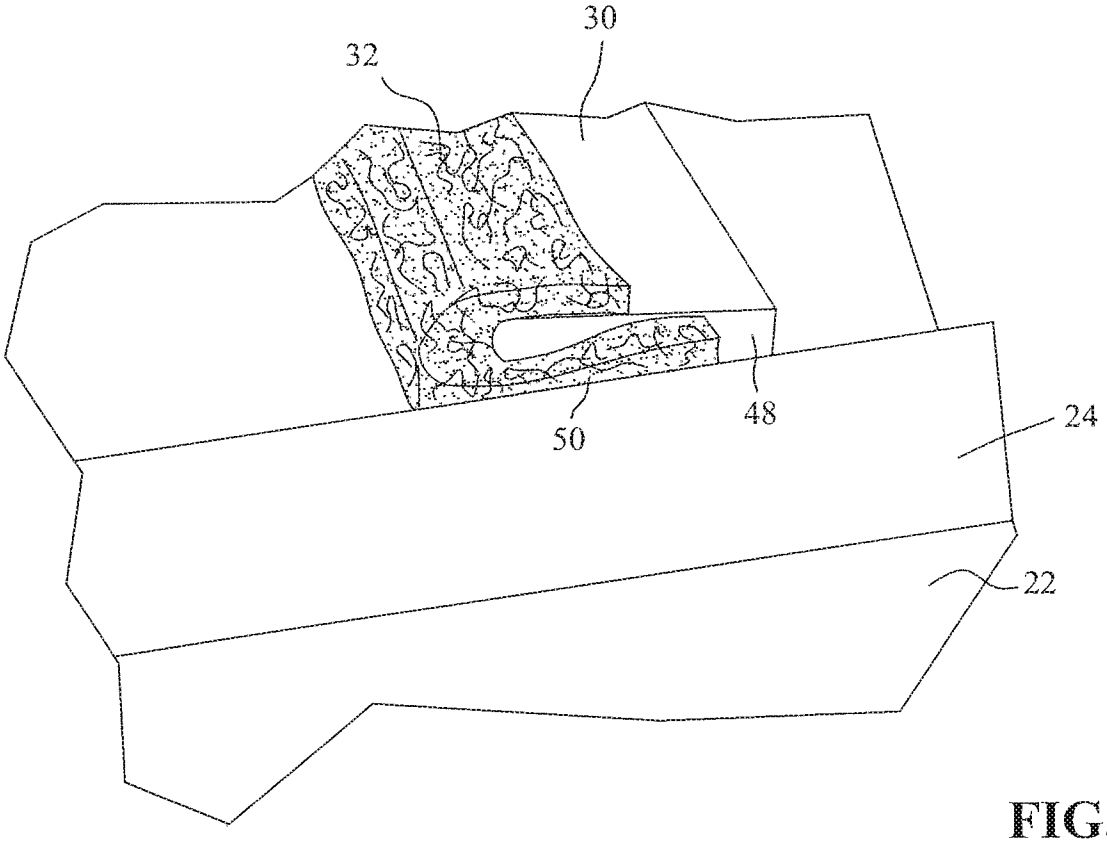
FIG. 4 is a perspective end view of the vent part and filter member adjacent the joint or stiffener of the profiled roof.
Figure 5:
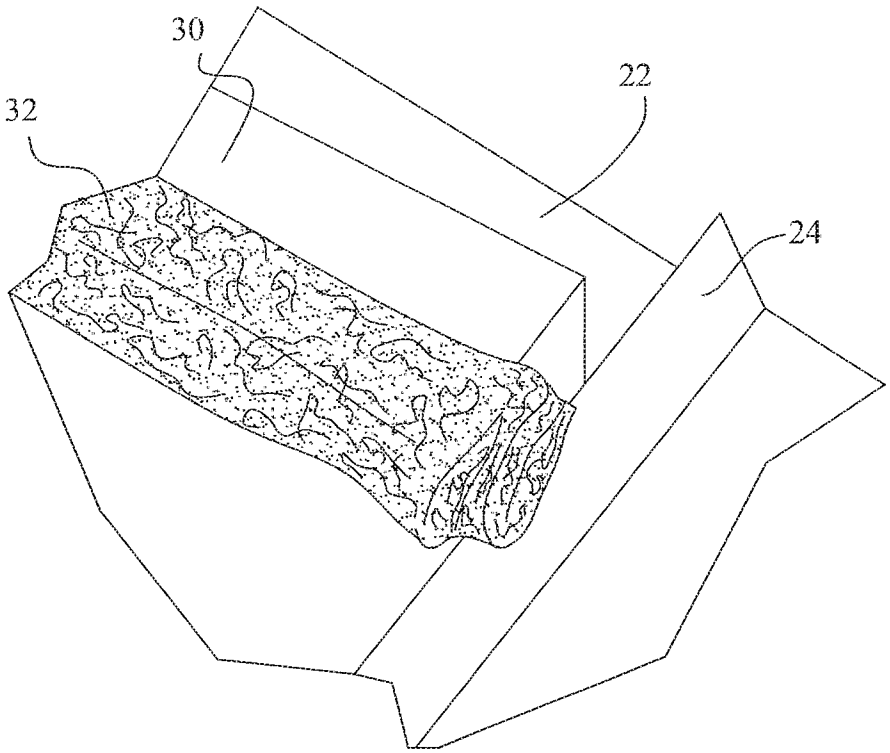
FIG. 5 is a front perspective view of an end of a vent part and filter member.

As best shown in FIG. 7, extensions 50 are left freely extending beyond ends 48 of vent parts 30. When being installed, an installer folds the vent parts about the end and tucks the extensions in the gap between the vent parts and the joint seams or stiffening members 24 as best shown in FIGS. 3 and 4. As the material of which the filter members are manufactured from is resilient, the filter material springs out filing the gap and preventing entrance of undesired moisture or debris. Having the extensions unattached allows filling of the gap area as opposed to having the extensions attached or otherwise adhered to end 48 of vent parts 30. Furthermore, with the filter member attached as shown in FIG. 7 around the outer openings of vent passages 40, the filter member forms a barrier when folded over that keeps out moisture, debris, etc.

Once the vent parts are fitted into place and filter members properly positioned filling any gaps, cleats 36 may be attached if desired. As shown in FIG. 2, screws 72 or other fasteners are used to mount the cleats through vent parts 30 into roof 12. Once attached, cap engagement portions 64 extend away from ridge 14 and may be used to mount ridge cap 34. As shown in FIG. 1, ridge cap 34 includes inward extending lips or projections 80 along the bottom ends thereof. The ridge cap may be slid along ridge 14 such that lips 80 are engaged beneath cap engagement portions 64 thereby holding ridge cap 34 in place over vent opening 14. The advantage of this embodiment is that the ridge cap covers screws 72 and no externally exposed fasteners are required or visible through the ridge cap to hold it in place. It should further be appreciated that the angled side edges 74 of cap engagement portion 64 helps facilitate sliding the ridge cap over cleats 36.

Figure 8:
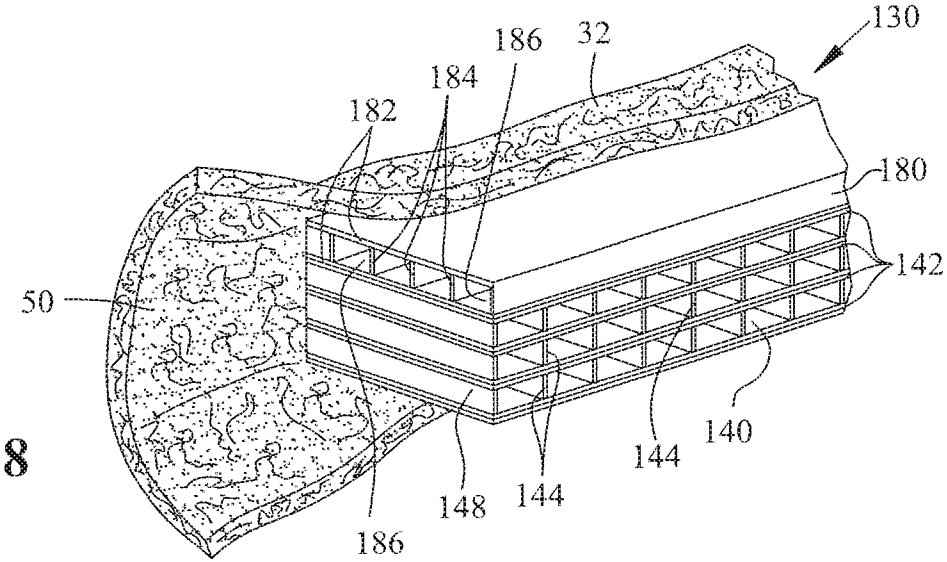
FIG. 8 is an end perspective view of an alternate embodiment vent part with a filter member.

Now referring to FIG. 8, an alternate embodiment vent part 130 is shown. This embodiment may prove advantageous when additional height is required of the vent part but for optimal ventilation, it is not desired to have vent passages extending through the entire height of the vent part. Additionally, the embodiment shown provides additional stiffness and strength to the vent parts. Vent part 130 has similar vent openings 140, plies 142, and cross members 144 as respective vent passages, plies, and cross members 40, 42, and 44, respectively, of vent part 30. Additionally, vent part 130 includes an additional layer 180. In the embodiment shown, layer 180 includes outer plies 182 and cross members 184, which define through passages 186. However, as can be seen in FIG. 8, through passages 186 run transversely to vent passages 140 such that layer 180 will not provide or add to venting of roof 12 from vent opening 20. In this manner, the vent part 130 can be made to have the precise desired number/cross-sectional area of vent passages, regardless of the height. It should be appreciated that layer 180 may be made of heavier and thicker material than the lower plies coinciding with vent parts 30. This can provide additional strength and stiffness to vent member 130. It should further be appreciated that although just one layer 180 is shown in FIG. 8, additional layers 180 may be provided and/or layers 180 may be placed beneath all plies 142 and/or layers 180 may sandwich plies 142 and vent passages 140. It should further be appreciated that although including through passages 186 reduces the cost and weight of vent part 130, layers 180 may be manufactured from a solid material and/or a lighter space filing material such as an open or closed cell foam. Vent parts 130 may be assembled to roof 12 in a similar manner as vent parts 30 and cleats 36 and roof cap 34 can also be attached and used in a similar manner.

While the invention has been taught with specific reference to these embodiments, one skilled in the art will recognize that changes can be made in form and detail without departing from the spirit and scope of the invention. This application is intended to cover any variations, uses, or adaptations of the invention using its general principles. Further, this application is intended to cover such departures from the present disclosure as has come within the known or customary practice in the art to which the invention pertains and which fall within the limits of the appended claims or equivalents thereof.

The invention claimed is:

1. A roof ventilation system configured to be mounted on a profiled paneled roof for venting air from a vent opening in the roof, the roof ventilation system comprising:

a vent part including a plurality of vent passages, a plurality of plies configured to be mounted substantially horizontal to the profiled roof panels and a plurality of cross members extending between each ply, said plies and cross members defining said vent passages; and a filter member attached to outer surfaces of said vent part, said filter member being made from a resilient material, and said filter member including extensions extending beyond a length of said vent part.

2. The roof ventilation system configured to be mounted on a profiled paneled roof for venting air from a vent opening in the roof as set forth in claim 1, wherein said vent part is configured to be mounted between adjacent upstanding projections on the profiled paneled roof, and the vent passages run substantially parallel to the projections.

3. The roof ventilation system configured to be mounted on a profiled paneled roof for venting air from a vent opening in the roof as set forth in claim 2, wherein said extensions are located between the vent parts and respective projections.

4. The roof ventilation system configured to be mounted on a profiled paneled roof for venting air from a vent opening in the roof as set forth in claim 3, wherein said filter member is provided in a sheet form and is in contact with outer surfaces of lower and upper plies of the vent part.

5. The roof ventilation system configured to be mounted on a profiled paneled roof for venting air from a vent opening in the roof as set forth in claim 4, wherein the filter member covers outer openings of the vent passages.

6. The roof ventilation system configured to be mounted on a profiled paneled roof for venting air from a vent opening in the roof as set forth in claim 5, wherein before installation, said extensions have a generally U-shaped configuration.

7. The roof ventilation system configured to be mounted on a profiled paneled roof for venting air from a vent opening in the roof as set forth in claim 6, wherein when installed, the extensions are folded about outer ends of the vent parts and the resilient material of the filter members expands to fill any gaps between the outer ends of the vent parts and the projections.

8. The roof ventilation system configured to be mounted on a profiled paneled roof for venting air from a vent opening in the roof as set forth in claim 1, including adhesive pads attached to an outer surface of the plies for temporarily attaching said vent part to the profiled paneled roof.

9. The roof ventilation system configured to be mounted on a profiled paneled roof for venting air from a vent opening in the roof as set forth in claim 1, further including at least one additional layer of material attached to an outer ply of the vent part.

10. The roof ventilation system configured to be mounted on a profiled paneled roof for venting air from a vent opening in the roof as set forth in claim 9, wherein the additional layer of material includes a plurality of plies, cross members extending between each ply, and through passages defined by said plies and cross members of said additional layer, said through passages extending substantially perpendicular to said vent passages.

11. A method for venting a roof covered with profiled panels, including the steps of:

providing a vent opening in a roof covered with a plurality of profiled panels;

providing a vent part having a plurality of vent passages, a plurality of plies, and a plurality of cross members extending between each ply, the plies and cross members defining the vent passages;

attaching a filter member to outer surfaces of the vent part, the filter member made of a resilient material and including extensions extending beyond the length of the vent part;

providing a plurality of upstanding projections on the profiled panels on the roof, the projections extending substantially perpendicular to the vent opening;

folding the extensions about outer ends of the vent part; and mounting the vent part between adjacent projections so that the vent passages run substantially parallel to the projections.

12. The method for venting a roof covered with profiled panels, as set forth in claim 11 including the step of, attaching the filter member to outer surfaces of upper and lower plies of the vent part.

13. The method for venting a roof covered with profiled panels, as set forth in claim 12, further including the steps of, providing adhesive pads on the outer surface of the lower ply, said adhesive pad not covered by said filter member, and temporarily attaching said vent part to one of the metal panels on the roof using the adhesive pads.

14. The method for venting a roof covered with profiled panels as set forth in claim 13, wherein the extensions have a substantially U-shaped configuration before being installed on the roof.

15. The method for venting a roof covered with profiled panels as set forth in claim 14, wherein when installed on the roof between projections, said extensions on said filter members expand to fill any gaps therebetween.

16. The method for venting a roof covered with profiled panels, as set forth in claim 15, wherein said filter member covers inner openings of the vent passages.

17. The method for venting a roof covered with profiled panels as set forth in claim 11, including the steps of providing a ridge cap, and covering the vent opening and said vent part with said ridge cap.

18. The method for venting a roof covered with profiled panels, as set forth in claim 11, including the step of providing at least one additional layer on said vent part, said additional layer having a configuration different than said vent passages, plies and cross members of said vent part.

19. The method for venting a roof covered with profiled panels, as set forth in claim 18, including the steps of providing a plurality of through passages, plies, and cross members, to define said additional layer, said through passages running substantially transverse to said vent passages.

20. The method for venting a roof covered with profiled panels, as set forth in claim 19, including the step of attaching the additional layer to an outer surface of one of the plies on the vent part.

21. The method for venting a roof covered with profiled panels, as set forth in claim 11 further including the steps of:

providing a cleat having an engagement portion, fasteners, and a ridge cap having inwardly extending projections, the engagement portions of the cleat configured to engage the projections on the ridge cap;

placing the cleat over the vent part so that the engagement portion extends away from the vent openings and beyond and end an outer end of the vent part;

mounting the cleat and the vent part to the profiled panels using the fasteners; and mounting the ridge cap over the vent opening by engaging the engagement portion of the cleat with the projections on the ridge cap, the ridge cap covering the fasteners.

22. The roof ventilation system configured to be mounted on a profiled paneled roof for venting air from a vent opening in the roof as set forth in claim 1, further including a cleat having an engagement portion and a ridge cap for covering the vent opening, the ridge cap including projections, the engagement portion of the cleat configured to engage the projections on the ridge cap.

23. The roof ventilation system configured to be mounted on a profiled panel roof for venting air from a vent opening in the roof as set forth in claim 22 wherein the cleat is mounted to an upper surface of the vent part and the engagement portion extends past an outer surface of the vent part and away from the vent opening.

24. The roof ventilation system configured to be mounted on a profiled panel roof for venting air from a vent opening in the roof as set forth in claim 23 wherein the cleat and vent part are attached to the profiled panel roof using fasteners, and the ridge cap is mounted over the vent opening with the engagement portion of the cleat engaging the projections of the ridge cap so that the ridge cap is held firmly in place and the fasteners are covered by the ridge cap.

25. A roof ventilation system configured to be mounted on a profiled paneled roof for venting air from a vent opening in the roof, the roof ventilation system comprising:

a plurality of vent parts, each including a plurality of passages, a plurality of plies configured to be mounted substantially horizontal to the profile roof panels and a plurality of cross members extending between each ply, said ply and said cross members defining said vent passages;

a plurality of cleats, each cleat having an engagement portion;

the cleats located on the top of the vent parts, and the cleats and the vent parts mounted to the roof using fasteners; and a ridge cap, the ridge cap including inwardly extending projections, the ridge cap covering the vent opening and the fasteners and held in place by engagement of the projections with the engagement portions.

26. The roof ventilation system configured to be mounted on a profiled paneled roof for venting air from a vent opening in the roof as set forth in claim 25 wherein the cleats include three planes comprising a base portion, a riser portion, and the cap engagement portion.

27. The roof ventilation system configured to be mounted on a profiled paneled roof for venting air from a vent opening in the roof as set forth in claim 26 wherein the base portion and the cap engagement portion are substantially parallel.

28. The roof ventilation system configured to be mounted on a profiled panel roof for venting air from a vent opening in the roof as set forth in claim 25 further including filter members attached to the outer surfaces of each vent part, said filter members being made from a resilient material, and said filter members including extensions extending beyond a length of the vent part.

29. The roof ventilation system configured to be mounted on a profiled panel roof for venting air from a vent opening in the roof as set forth in claim 28, wherein when installed, the extensions on the filter members are folded about outer ends of the respective vent parts and the resilient material of the filter members expands to fill any gaps between the outer ends of the vent parts and projections extending upwardly from the profiled paneled roof.

* * * * *